United States Patent [19]

Hesketh et al.

[11] Patent Number: 5,053,266

[45] Date of Patent: Oct. 1, 1991

[54] VENTILATION TILE WITH PLIABLE EDGE AREAS

[75] Inventors: Mark L. Hesketh, Whyteleafe; Peter Alker, Ross-on-Wye, both of England; Karl-Heinz Hofmann, Muecke, Fed. Rep. of Germany; Wilhelm Rottger, Heusenstamm, Fed. Rep. of Germany; Wendelin Wanner, Geisenheim, Fed. Rep. of Germany

[73] Assignee: Dovetail Building Products Limited, England

[21] Appl. No.: 452,688

[22] Filed: Dec. 18, 1989

[30] Foreign Application Priority Data

Dec. 23, 1988 [GB] United Kingdom ..... 8830119
Apr. 28, 1989 [DE] Fed. Rep. of Germany ..... 3914025

[51] Int. Cl.[5] ..... E04B 7/18; B32B 3/10

[52] U.S. Cl. ..... 428/192; 428/137; 428/139; 428/77; 428/182; 428/343; 428/463; 428/518; 428/157; 428/159; 428/163; 428/167; 428/169; 52/199; 52/58; 52/60; 52/536

[58] Field of Search ..... 428/137, 139, 77, 192, 428/182, 343, 463, 518, 157, 159, 163, 167, 169; 52/199, 58, 60, 536

[56] References Cited

U.S. PATENT DOCUMENTS

| | | | |
|---|---|---|---|
| 3,874,138 | 4/1975 | Storch | 52/199 |
| 3,895,467 | 7/1975 | Clement | 52/199 |
| 4,372,090 | 10/1981 | Shichijo | 428/192 X |
| 4,573,291 | 3/1986 | Hofmann | 52/43 |
| 4,635,409 | 1/1987 | Vandemore | 52/60 |
| 4,685,256 | 8/1987 | Alkjaer | 52/60 X |
| 4,717,614 | 1/1988 | Bondoc et al. | 428/172 X |
| 4,803,111 | 2/1989 | Mansell | 428/137 X |
| 4,934,117 | 6/1990 | Barksdale | 52/199 X |

FOREIGN PATENT DOCUMENTS

| | | | |
|---|---|---|---|
| 0090513 | 5/1983 | European Pat. Off. . | |
| 0304995 | 1/1989 | European Pat. Off. . | |
| 2734689 | 2/1979 | Fed. Rep. of Germany | 52/199 |
| 1080837 | 8/1967 | United Kingdom . | |
| 2199860 | 7/1988 | United Kingdom . | |

*Primary Examiner*—Ellis P. Robinson
*Assistant Examiner*—William P. Watkins, III
*Attorney, Agent, or Firm*—Spensley Horn Jubas & Lubitz

[57] ABSTRACT

A roof tile construction includes a ventilation tile having pliable portions provided by a membrane of PVC (polyvinyl chloride) which is readily deformable to complement the shapes and configurations of adjacent roof tiles, whereby gaps between the headlap, side-lock and tail portions of tiles immediately adjacent the ventilation tile are substantially closed. The ventilation tile also includes a rigid body portion for supporting the membrane, the body portion being generally of planar configuration and being provided with adapter means for accommodating ventilation means such as a ventilation cap, or a soil pipe. The membrane is also of generally planar configuration and includes a headlap portion, oppositely disposed side-lock portions and a tail portion which extends beyond the rigid body portion. The tail portion is provided with an adhesive coating and with stiffening means in order to secure the tail portion to and maintain conformity of the tail portion with the profile of the headlap portion of an adjacent tile, and is also provided with corrugations extending across the width thereof. A depending wall portion at the headlap portion of the rigid body portion assists in locating the ventilation tile on a roof batten.

12 Claims, 7 Drawing Sheets

VENTILATION TILE WITH PLIABLE EDGE AREAS

BACKGROUND OF THE INVENTION

The present invention is concerned with improvements in or relating to ventilation tiles and is particularly, although not exclusively, concerned with improvements in ventilation tiles which may readily be adapted for use with a wide range of roof tiles, ventilation means and soil pipes.

Hitherto, ventilation tiles, e.g. those tiles on a tiled roof which comprise or consist of means for venting the roof or providing openings for accommodating outlet end portions of soil pipes, have been of manifold shapes and configurations. In general, it has been the usual practice to provide a ventilation tile to suit each shape and configuration of roof tile; thus, "plain" tiles will be complemented by one configuration of ventilation tile and "bold roll", "Roman" or "Double Roman" tiles will each be complemented by an appropriately shaped ventilation tile.

This practice has meant that manufacturers and stockists of such products have had to contend with large stocks of specials in order to meet the requirements of the end users.

British Patent Specification No. 1080837 discloses a roofing element for forming a weatherproof seal between a member, such as a pipe, and a roof from which the member projects. The element comprises a slate-like slab or panel of neoprene or butyl synthetic rubber or the like which may be stiffened by an internal wire mesh and/or stiffening elements applied to edge portions of the element. Such an arrangement will only provide a partial answer to the problems to be overcome for, whereas the slab or panel may be shaped to suit the shape and configuration of adjoining tiles, it will lack the necessary rigidity to enable it to cope with high snow loadings or the high impact loading encountered in hail conditions. In addition, it lacks the side-lock features of a true tile which assist in sealing the roof against the ingress of rainwater and are effective in channeling the rainwater towards the roof gutter.

SUMMARY OF THE INVENTION

The present invention seeks to overcome these disadvantages and conveniently provides a ventilation tile comprising pliable portions provided by a membrane of such material. When the tile is in use on a roof provided with roof tiles of conventional shapes and configurations, as hereinbefore defined, the membrane is readily deformed to complement the shapes and configurations of said roof tiles whereby gaps between headlap, side-lock and tail portions of the tiles immediately adjacent said ventilation tile are closed or substantially so. The ventilation tile also comprises a rigid body portion for supporting said membrane, which body portion is generally of planar construction and is provided with adapter means for accommodating, in use, roof ventilation means or soil pipes. The membrane which is generally planar comprises a headlap portion, oppositely disposed side-lock portions and a tail portion, which tail portion extends beyond the rigid body portion thereof.

The tail portion of the membrane may conveniently also comprise stiffening means whereby when the tile is in use as aforesaid and the tail portion of the membrane is formed to a required contour in accordance with the head lap profile of an adjacent tile, the stiffening means is effective to retain the tail portion of the membrane in such condition.

The tail portion may also be conveniently provided with corrugations extending substantially across the width thereof between the oppositely disposed side lock portions thereof.

Conveniently the stiffening means comprises a deformable metal or metalized plastics (plastic molded to a metal lamina) element provided in or on said membrane and preferably the stiffening means comprises an expanded metal sheet attached to an underside of the tail portion of said membrane.

In addition the tail portion is conveniently precoated with mastic adhesive prior to assembly on a roof wherein, when the tile is in use on a roof, the tail portion thereof is fixedly secured to the headlap portion of an immediately adjacent tile therebelow.

In one convenient embodiment provided by the invention, the pliable material is a plasticized PVC (polyvinyl chloride).

Means are also conveniently provided for locating the tile on a roof batten of a roof, the location means conveniently comprising a depending wall portion provided at the headlap portion of the rigid body portion which is preferably moulded from uPVC (unplasticized polyvinyl chloride).

The present invention also conveniently provides a tiled roof when incorporating at least one ventilation tile as hereinbefore described.

BRIEF DESCRIPTION OF THE DRAWINGS

There now follows by way of example a detailed description of one embodiment provided by the invention which description is to be read with reference to the accompanying drawings in which.

DETAILED DESCRIPTION OF THE INVENTION

In order to overcome the general lack of versatility of prior art ventilation tiles, the present invention provides a novel ventilation tile 2 with a portion thereof of pliable material which tile may thus be adapted, in use, to suit the shapes and configurations of the manifold roofing tiles available throughout the building industry.

Figure 2:
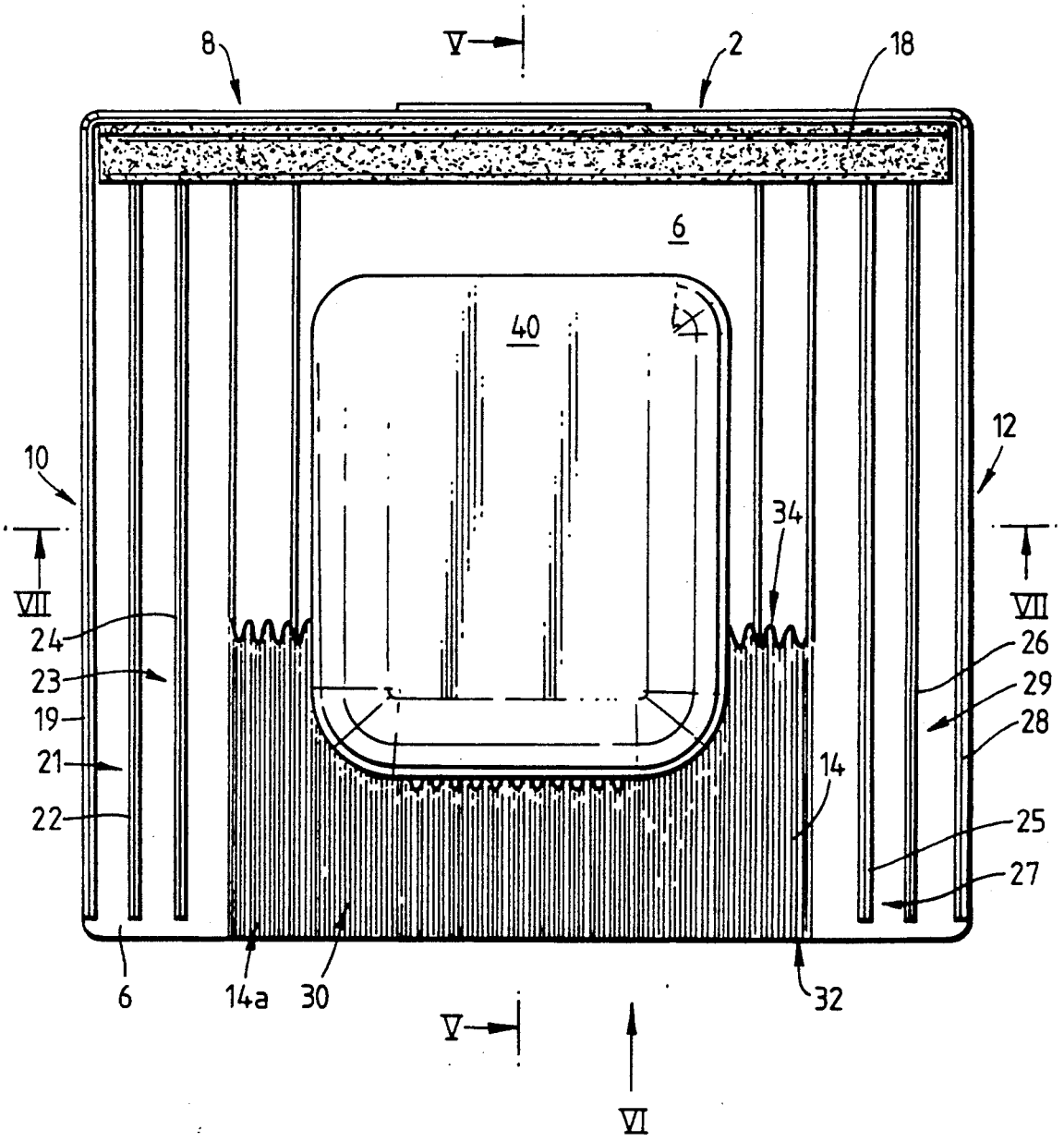
FIG. 2 is a plan view of the ventilation tile depicted in FIG. 1.
Figure 3:
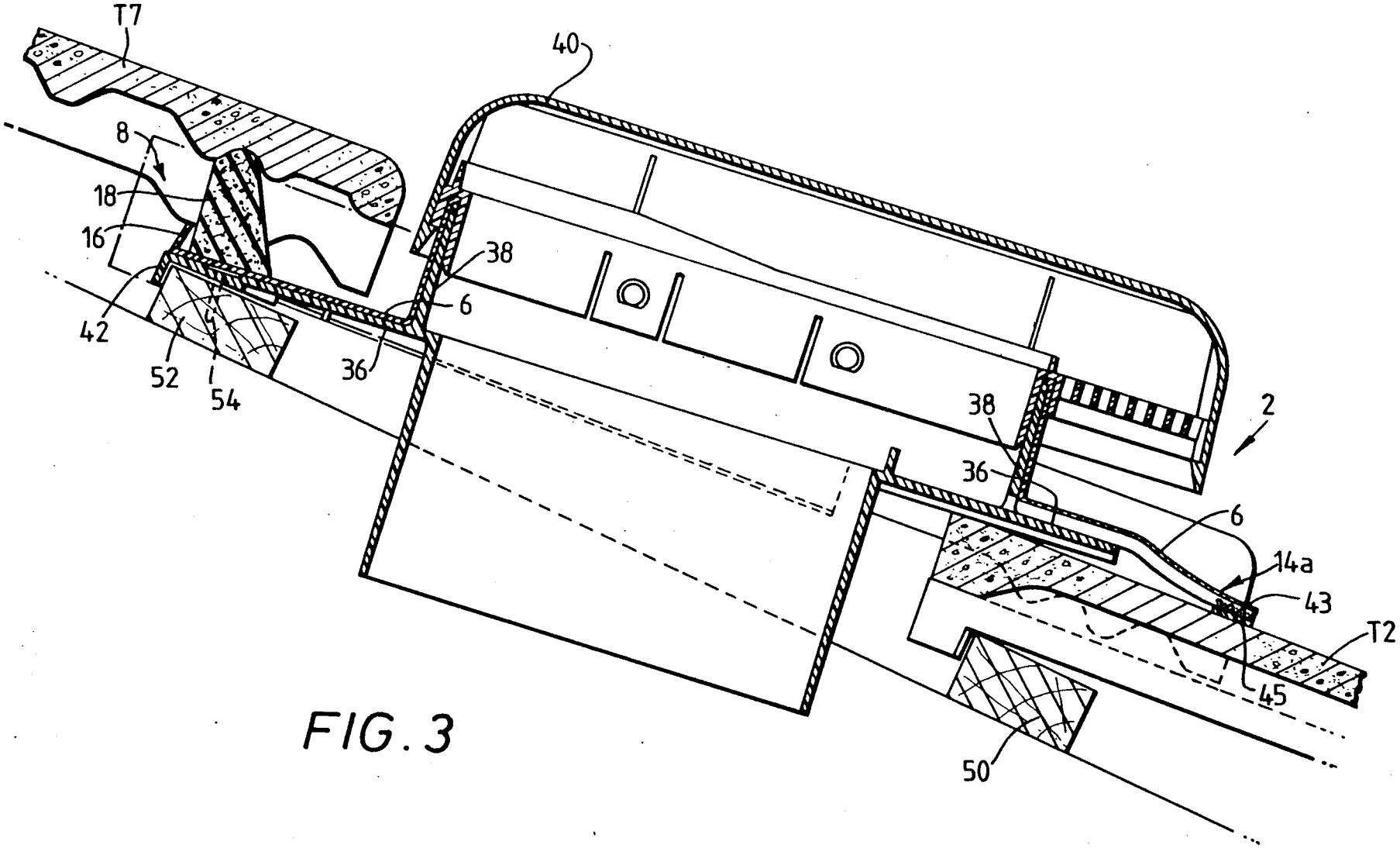
FIG. 3 is a fragmentary section view taken along the line III—III in FIG. 1.
Figure 5:
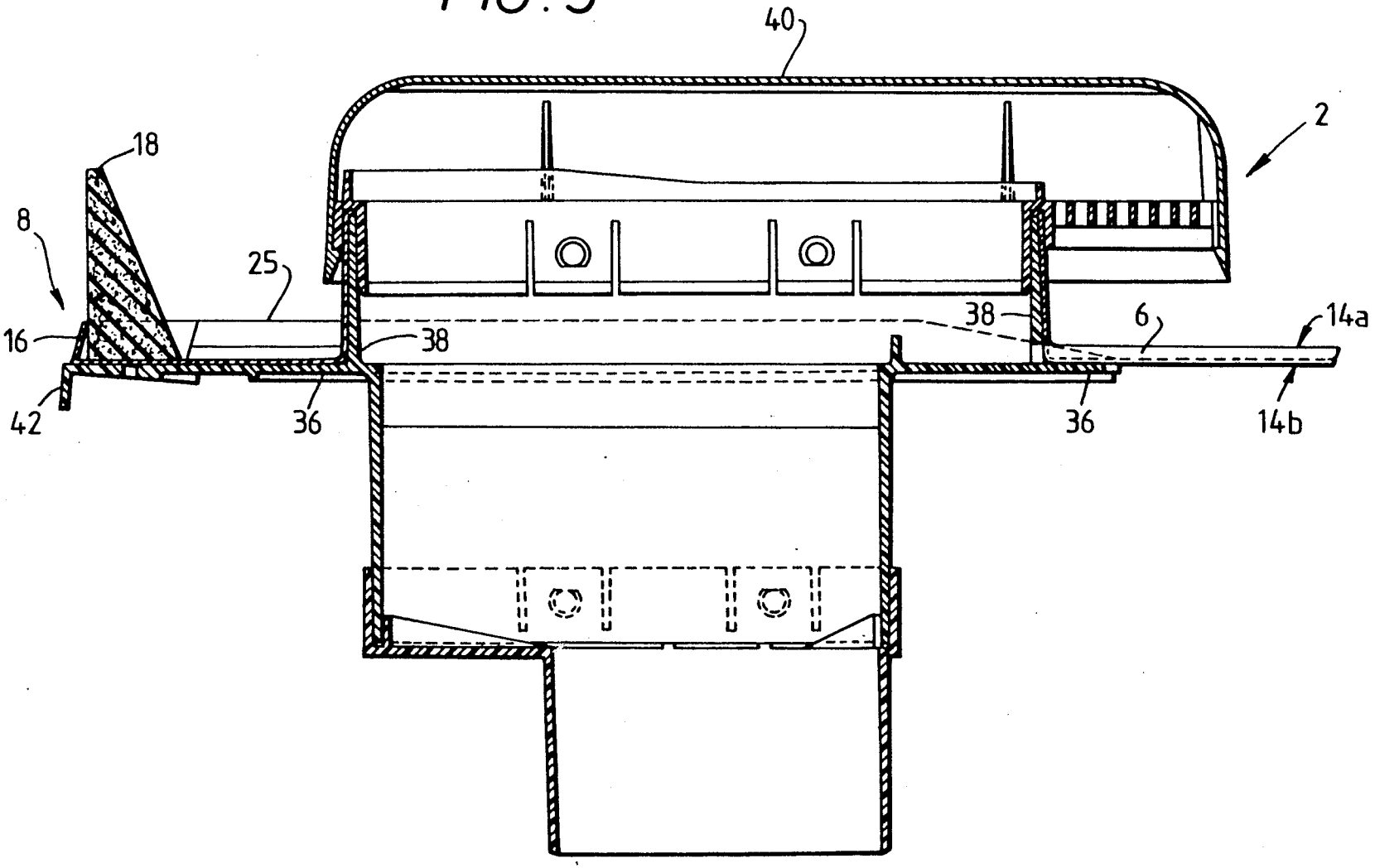
FIG. 5 is a section view taken along the line V—V of FIG. 2.

The tile portion of pliable material is provided by a membrane 6 of plasticized PVC. The membrane 6 is generally planar in cross-section and rectangular in plan view, as shown in FIG. 2, and comprises a headlap portion 8, oppositely disposed side-lock portions 10 and 12 and a tail portion 14, as shown in FIGS. 2, 3 and 5.

Figure 6:
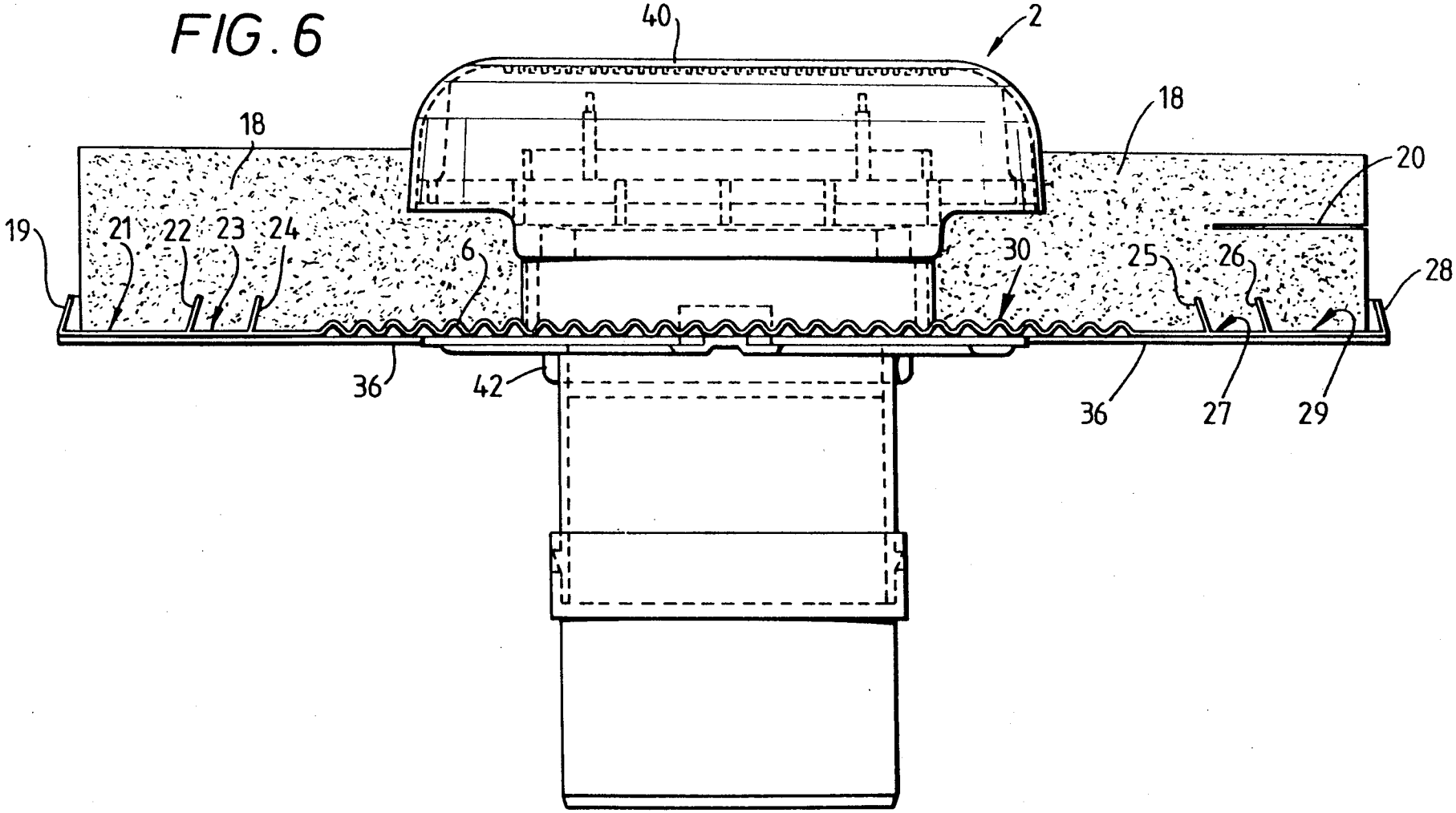
FIG. 6 is a front view of the ventilation tile seen in the direction of arrow VI in FIG. 2.
Figure 7:
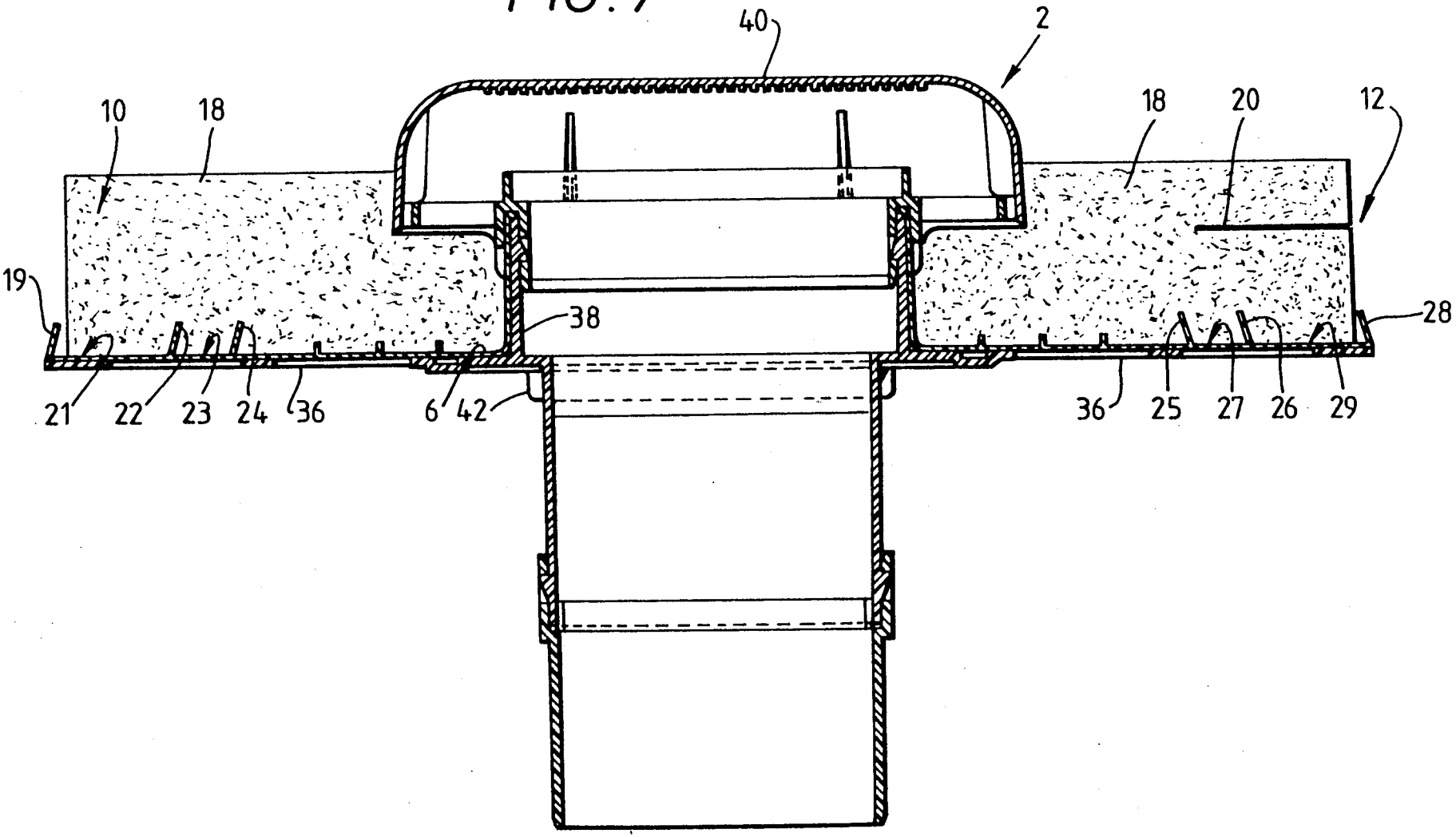
FIG. 7 is a section view taker along the line VII—VII of FIG. 2.

The headlap portion 8 of the membrane 6 comprises an upstanding rib 16. A sealing element 18 located on the membrane 6 at the headlap portion 8 abuts against said rib 16. The sealing element 18, which extends laterally of the tile 2 as shown in FIGS. 2, 6 and 7, is of sponge rubber or the like material and, as shown in FIGS. 3 and 5. the element 18 has a cross-section substantially akin to that of a truncated cone. At the right hand end of the element 18, i.e., at the end nearest to the side lock 12 of the membrane 6, the element 18 is split at 20, as shown in FIGS. 6 and 7, for a purpose to be made clear hereinafter.

The oppositely disposed side-lock portions 10 and 12 are provided with upstanding ribs 19, 22 and 24 and 25, 26 and 28 respectively, as shown in FIGS. 2, 4, 6 and 7. Such ribs extend longitudinally of the membrane 6 substantially along the entire length thereof. Thus, the ribs 19, 22 and 24 define adjacent channels 21 and 23 and the ribs 25, 26 and 28 define adjacent channels 27 and 29, as shown in FIGS. 2, 4, 6 and 7.

Figure 1:
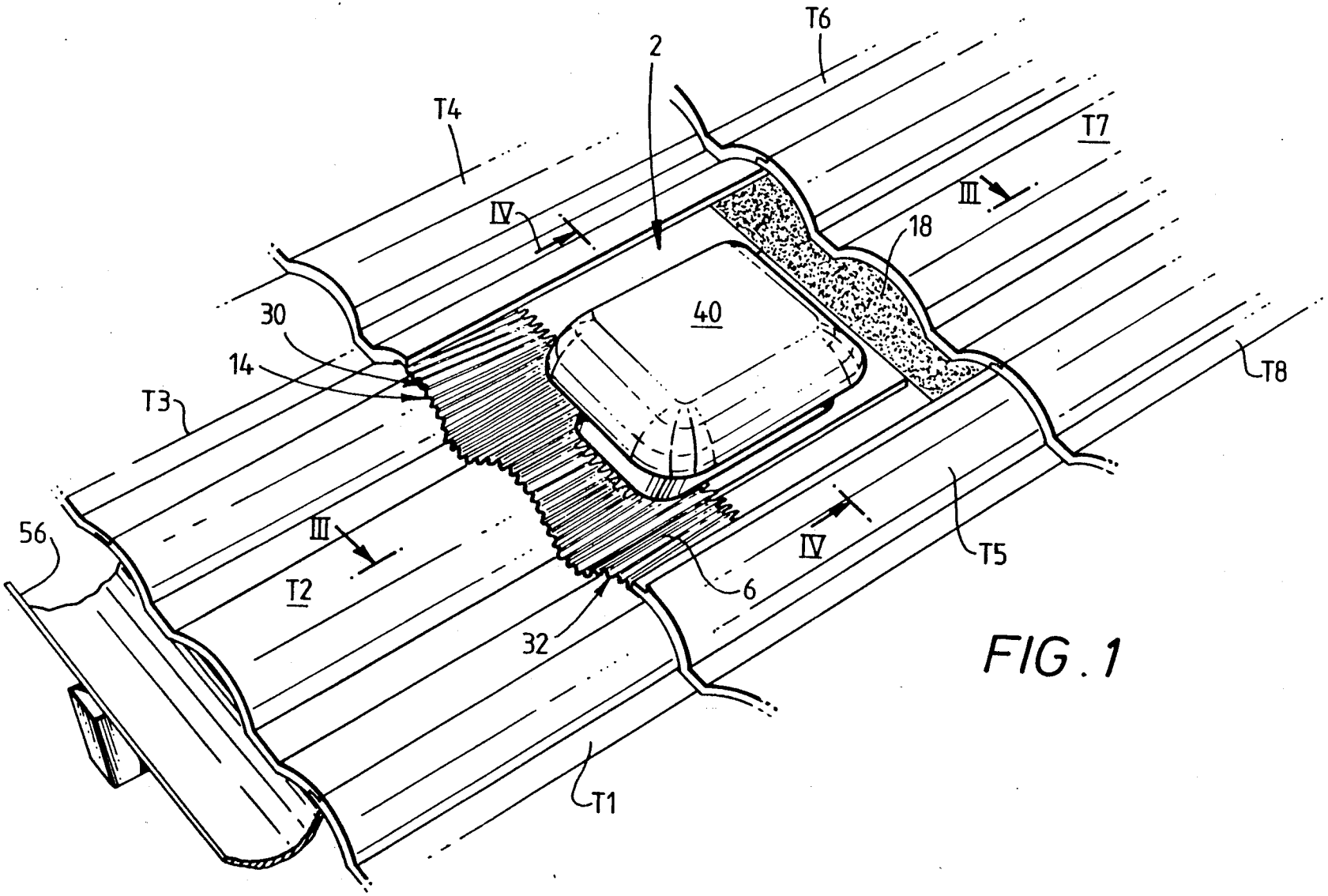
FIG. 1 is right hand side upper perspective view of a novel ventilation tile in accordance with the invention, in use on a roof.

The ribs and channels provide means characteristic of conventional concrete or clay tiles to assist in the sealing of the roof and the channeling of rainwater towards a gutter 56 of a roof, as shown in FIG. 1.

The tail portion 14 of the membrane 6 is defined by a corrugated section 30 which extends between the ribs 24 and 25 and from a lower edge 32 to a mid-portion 34 of the membrane 6 as shown in FIG. 2.

Figure 4:
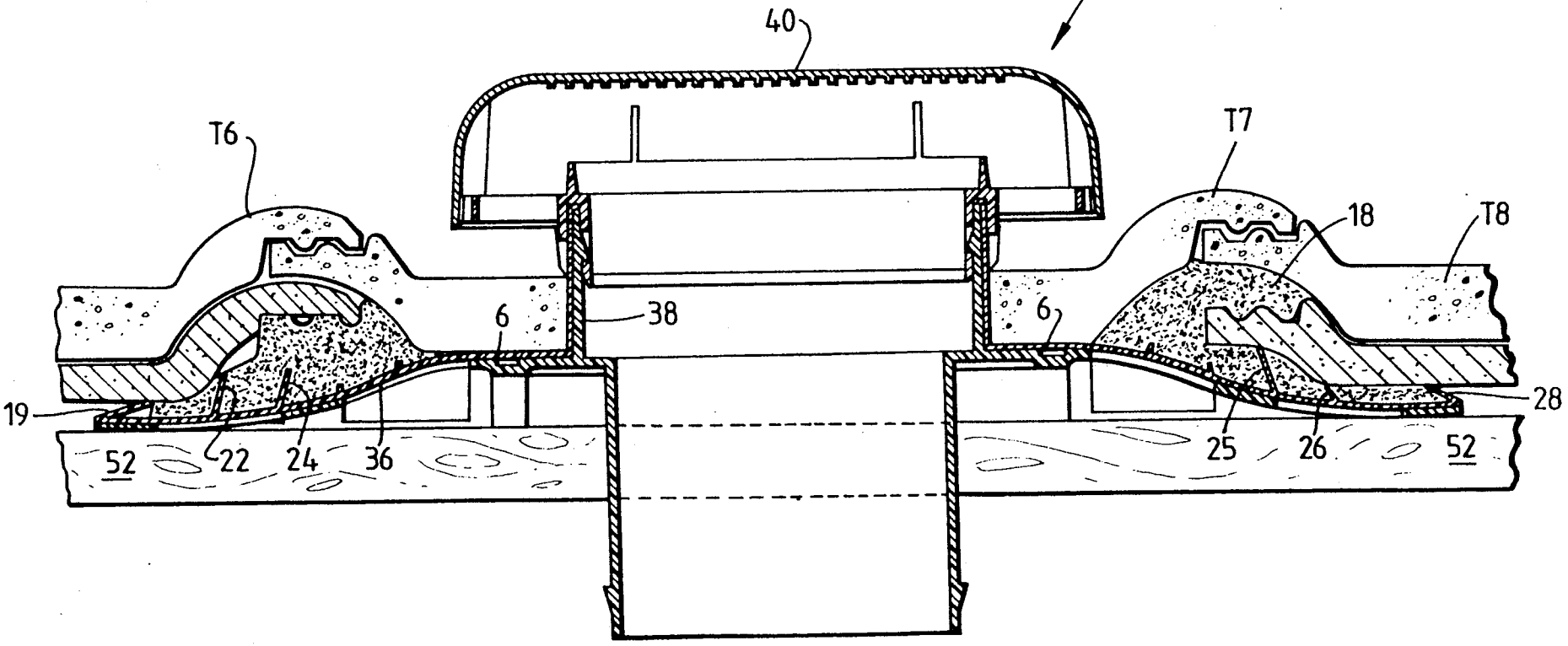
FIG. 4 is a fragmentary section view taken along the line IV—IV of FIG. 1.

The tile 2 also comprises a semi-rigid body portion 36 which is generally planar in construction but is sufficiently bendable in use to be deformed from its generally planar condition to that condition shown in FIG. 4. The portion 36 comprises an upper adapter means provided by a sleeve 38 for accommodating, in use, a roof ventilation cap 40 as shown in FIGS. 1 to 7.

The cap 40 forms no part of the present invention; thus, no further description of this part is included herein.

The body portion 36 is moulded from PVC or the like material and extends to underlie the entire width of the membrane 6 as shown in FIGS. 4, 6 and 7. However, the body portion 36, while extending wholly beneath the headlap portion 8 of the membrane 6 and being provided with a depending hanging nib 42, as shown in FIGS. 3, 5, 6 and 7, only extends for approximately one-third of the length of the corrugated section 30 of the tail portion 14 of the membrane 6, as shown in FIG. 3. Thus, a portion **14*a* of the tail portion 14** is left unsupported for a purpose to be made clear hereinafter.

The tail portion **14*a* is provided on its underside 14*b* with a stiffening element 43, as shown in FIG. 3, of expanded metal for a purpose to be made clear hereinafter. In addition, the underside 14*b* of the tail portion 14 is coated with a mastic adhesive 45**, which coating is protected by a layer of wax paper (not shown) for transportation purposes.

When the novel tile 2 is to be used on a roof, a tiler locates a row of tiles T1, T2 and T3 on a roof batten 50 in the usual manner, as shown in FIGS. 1 and 3. He then detaches the layer of wax paper from a tile 2 to reveal the mastic layer 45. The tile 2 is then placed on the roof with the hanging rib 42 located on an associated batten 52 as shown in FIG. 3, and with the tail portion 14 overlying the headlap portion of the tile T2. Fastening nails 54 are then used to secure the tile 2 to its batten 52. The tiler then presses upon the unsupported tail portion **14*b* to deform it into the shape and configuration of the headlap portion of the tile T2. At this time, the stiffening element is also deformed to take up a new permanent condition and the mastic adhesive is pressed into contact with the headlap portion of the tile T2 to fix the lower end of the tile 2 and close the gap between the two tiles 2 and T2**.

The tiler then places tiles T4 and T5 in position as shown, with side lock portions of the Tiles T4 and T5 overlying the ribs 19, 22 and 24 and 25, 26 and 28 respectively. Thus, the side lock portions between the tiles T4, 2 and T5 are sealed against the ingress of driven rain and insects. Further, because the ribs 19, 22 and 24 and 25, 26 and 28 are slanted inwardly towards a central longitudinal axis of the tile 2, there is a natural propensity for the ribs to be deformed by the adjoining tiles T4 and T5 to lean further towards said axis in order to increase the sealing and drainage characteristics thereof.

The tiler finally places a row of tiles T6, T7 and T8 as shown in FIG. 1, with a side lock portion of the tile T8 located in the slit 20 provided in the sealing member 18. The member 18 closes the gap between the headlap of the tile 2 and the tail of the tile T7.

It will be appreciated that the novel tile 2 provides a versatile solution to the problems and disadvantages of using rigid ventilation tiles or arrangements incorporating unsupported pliable membranes and the like.

Also, in addition to its use with the ventilation cap 40, the novel tile 2 may be utilized with soil pipes or the like.

It is also envisaged within the scope of this invention that the means for stiffening the tail portion **14*a* of the tail 14 may be provided by any appropriate device. For example, it may comprise any deformable metal or metalized plastics element provided in or on said tail portion 14*a***.

Other modifications may be made within the scope of the invention.

What is claimed is:

1. A ventilation tile comprising pliable portions provided by a membrane, the membrane being readily deformable to complement the shapes and configurations of adjacent roof tiles having headlap, side-lock and tail portions, whereby gaps between the headlap, side-lock and tail portions of tiles immediately adjacent the ventilation tile and adjacent portions of the membrane are substantially closed, the ventilation tile also comprising a rigid body portion for supporting the membrane, the body portion being generally of planar configuration and being provided with adapter means for accommodating another member at a central location thereon, and the membrane being generally planar and comprising a headlap portion having a rib, a sealing means, and a depending wall portion, oppositely disposed side-lock portions having ribs therein, and a tail portion, the tail portion extending beyond the rigid body portion and having an adhesive coating thereon.

2. A ventilation tile according to claim 1, wherein the tail portion of the membrane comprises stiffening means, whereby when the tail portion of the membrane is formed to a required contour in accordance with the headlap profile of an adjacent tile, the stiffening means is effective to retain the tail portion of the membrane in such condition.

3. A ventilation tile according to claim 2, wherein the stiffening means comprises a deformable metal element.

4. A ventilation tile according to claim 2, wherein the stiffening means comprises an expanded metal sheet attached to an underside of the tail portion of the membrane.

5. A ventilation tile according to claim 2, wherein the stiffening means comprises a metalized plastics element.

6. A ventilation tile according to claim 1, wherein the tail portion is provided with corrugations extending substantially across the width thereof between the oppositely disposed side lock portions thereof.

7. A ventilation tile according to claim 1, wherein the tail portion is pre-coated with mastic adhesive, whereby upon installation of the tile on a roof the tail portion may be fixedly secured to the headlap portion of an immediately adjacent tile therebelow.

8. A ventilation tile according to claim 1, wherein the membrane is made of plasticized polyvinyl chloride.

9. A ventilation tile according to claim 1, wherein the rigid body portion is moulded from unplasticized polyvinyl chloride.

10. A ventilation tile comprising the combination of a deformable membrane having a headlap portion having a rib, a sealing means, and a depending wall portion, opposite side-lock portion having ribs therein, and a tail portion having an adhesive coating thereon, and a rigid body portion having a sleeve for accommodating a ventilation cap, the rigid body portion being disposed beneath and supporting the membrane and being generally coextensive with the membrane at the headlap portion and the opposite side-lock portions and being shorter than the tail portion such that the tail portion extends beyond the rigid body portion.

11. The ventilation tile according to claim 10, wherein the membrane and the rigid body portion are both of generally planar configuration.

12. A roof tile construction comprising a plurality of roof tiles disposed in overlapping configuration and including at least one ventilation tile, the ventilation tile including a deformable membrane the membrane having a head lap portion including a rib, a sealing means, and a depending wall portion, opposite side-lock portions having ribs therein, and a tail portion having an adhesive coating the membrane being disposed in contact with and conforming to the shape of adjacent ones of the plurality of roof tiles at headlap, side-lock and tail portions thereof, and a rigid body portion supporting the membrane and including adapter means for accommodating ventilation means, the tail portion of the membrane extending beyond the rigid body portion.

* * * * *